United States Patent [19]

Schneider

[11] Patent Number: 4,523,140

[45] Date of Patent: Jun. 11, 1985

[54] PRECISION CURRENT MIRROR ARRAYS

[75] Inventor: Herbert A. Schneider, Boulder, Colo.

[73] Assignee: AT&T Bell Labs, Murray Hill, N.J.

[21] Appl. No.: 454,958

[22] Filed: Jan. 3, 1983

[51] Int. Cl.[3] ..... G05F 3/08

[52] U.S. Cl. ..... 323/315; 330/288

[58] Field of Search ..... 307/297; 323/315, 316, 323/317; 330/257, 288

[56] References Cited

U.S. PATENT DOCUMENTS 3,936,725 2/1976 Schneider .

4,166,971 9/1979 Schneider ..... 323/315

4,398,160 8/1983 Neidorff ..... 323/316 X 4,412,186 10/1983 Nagano ..... 330/288

*Primary Examiner*—Peter S. Wong

*Assistant Examiner*—Judson H. Jones

*Attorney, Agent, or Firm*—J. M. Graziano

[57] ABSTRACT

The subject array structure provides a large current mirror array which generates a plurality of substantially equal output currents from high impedance sources in response to at least one input control current. This array structure reduces the control current deviation problem of prior art current mirror circuits.

14 Claims, 10 Drawing Figures

EVEN-EVEN

| N | P | N/P | LDR | ARRAY PATTERN |
|---|---|---|---|---|
| ODD | EVEN | NON-INTEGER | 2 | PARTIAL VERTICAL SYMMETRY, MINIMIZE ASYMMETRY IN CENTER LDR + 1 ROWS |
| ODD | ODD | NON-INTEGER | (NEXT ODD INTEGER > N/P) -1 | |
| | | INTEGER | N/P - 1 | |
| EVEN | ODD | NON-INTEGER | (NEXT EVEN INTEGER > N/P) -1 | |
| | | INTEGER | N/P-1 | |
| EVEN | EVEN | NON-INTEGER | 0 | EXACT VERTICAL SYMMETRY |
| | | INTEGER | 0 | EXACT VERTICAL SYMMETRY |

FIG. 10

PRECISION CURRENT MIRROR ARRAYS

FIELD OF THE INVENTION

This invention relates to an array structure and more particularly to an arrangement for providing a large current mirror array which generates a plurality of substantially equal output currents from high impedance sources in response to at least one input control current.

BACKGROUND OF THE INVENTION

A current source is a very high output impedance electrical element which provides a predetermined (typically fixed) output current. The magnitude of the output current is substantially independent of both the voltage impressed across the current source and the load impedance presented to the output of the current source. In so-called "controlled" current sources, the magnitude of the output current, rather than being fixed, is a function of a control signal or a selected circuit parameter, such as a resistor value.

A current mirror circuit is a particular type of controlled current source in which the output current is controlled by the input current applied to the current mirror circuit. Current mirror circuits known in the art typically include first and second base-coupled transistors. The input or controlling current is extended to the collector of the first base-coupled transistor while the output or controlled current is obtained from the collector of the second base-coupled transistor. Base drive current for both the first and second base-coupled transistors is provided by control summing circuitry which draws a small amount of drive current from the bases of the first and second base-coupled transistors and inserts this drive current into the collector lead of one or the other of the base-coupled transistors.

Ideally, the input and output currents of a unity-gain current mirror circuit should have identical magnitudes. In practice, however, some input/output current deviation is always encountered due to the fact that the drive current for the current mirror circuit is diverted from the bases of the base-coupled transistors by the control summing circuit to the collector of one of these base-coupled transistors. In some current mirror circuits this deviation is as small as $$\frac{2}{(1+\beta)^2}$$

per unit of input current, wherein beta (beta) is the common-emitter current gain of the transistors comprising the current mirror circuit. In some applications, however, more precise input/output current matching may be required. Moreover, some applications may require a current mirror circuit having higher output impedance than is typically provided by these arrangements.

A step toward solving this current deviation problem is disclosed in U.S. Pat. Nos. 3,936,725 and 4,166,971 issued Feb. 3, 1976 and Sept. 4, 1979, respectively, to the above-named applicant. In these patents, added precision is achieved by cascading current mirror circuits to produce a square array containing at least three columns of serial-controlled semiconductor devices. Currents flowing through the various controlled semiconductor devices from one current mirror circuit to the next are essentially confined to flow in the respective columns of such serial-controlled devices.

Each current mirror circuit in this arrangement is a row of the square array and is provided with a base drive circuit responsive to the signal at the collector of at least one controlled transistor in the current mirror circuit. Such base drive-collector connections are distributed throughout the array structure on a one or more per row basis in accordance with a connection scheme which restricts each column of serial-controlled semiconductor devices to contain exactly the same number of base drive connections as does every other column.

SUMMARY OF THE INVENTION

The subject invention expands upon the basic concepts disclosed in the above-referenced patents. The environment of this invention is an n*m array of nodes, each of which produces a control signal that is proportional to the signal passing through the node. A control signal interconnection arrangement is disclosed to minimize the imbalance caused by control signals being fed forward. In particular, this control signal interconnection arrangement is illustrated by describing its application to high and medium precision current mirror array structures of arbitrary size. This is accomplished by providing a base drive-collector interconnection structure which minimizes the control current deviation problem of prior art current mirror circuits. In an $n \times m$ current mirror array, where n is the number of columns, m is the number of rows and where n is large, the number of base drive-collector interconnection possibilities becomes enormous. The subject current mirror array structures realize a base drive-collector interconnection configuration which reduces the output current deviation to the lowest possible level for each particular current mirror array configuration.

In particular, the current mirror array is divided into two segments. One segment is a region of symmetric base drive-collector interconnections while the other segment is a region of asymmetry. The symmetric region is defined by interconnecting the base terminals of all the transistors in the first row of the current mirror array to the control summing circuit. The resultant drive current is then fed forward equally to the collector terminals (i.e. columns of the current mirror array) of one or more of these transistors in the first row. This pattern of base-collector interconnections is then replicated in the last row of the current mirror array. A similar operation is repeated for the successive rows. The base terminals of all the transistors in the second row are interconnected to the control summing circuit and the resultant drive current is fed back to the collector terminals of a different set of one or more of these transistors (i.e. a different set of columns). Again this pattern is replicated, this time in the next-to-last row of the current mirror array.

This shifting of interconnections continues until all the columns of the current mirror array are receiving a share of the drive currents. This resulting pattern is then repeated in its entirety over and over again until there are an insufficient number of rows remaining in the current mirror array to completely reproduce the pattern. At this point, the rows remaining in the array represent the region of asymmetry.

The region of asymmetry is significantly smaller than the symmetric segment. The resultant number of possible base drive-collector interconnections is thereby greatly reduced from the number of combinations in the entire current mirror array. The current deviation in this asymmetric region is further reduced by using the array structure disclosed hereinbelow. Thus, the base drive-collector interconnections of the overall current mirror array can be selected in "cookbook" fashion by employing the structure disclosed herein, thereby reducing the current deviation caused by the base drive-collector interconnection.

BRIEF DESCRIPTION OF THE DRAWING

FIG. 10 illustrates, in table form, the precision array structure of this invention.

DETAILED DESCRIPTION OF THE DRAWINGS

Figure 1:
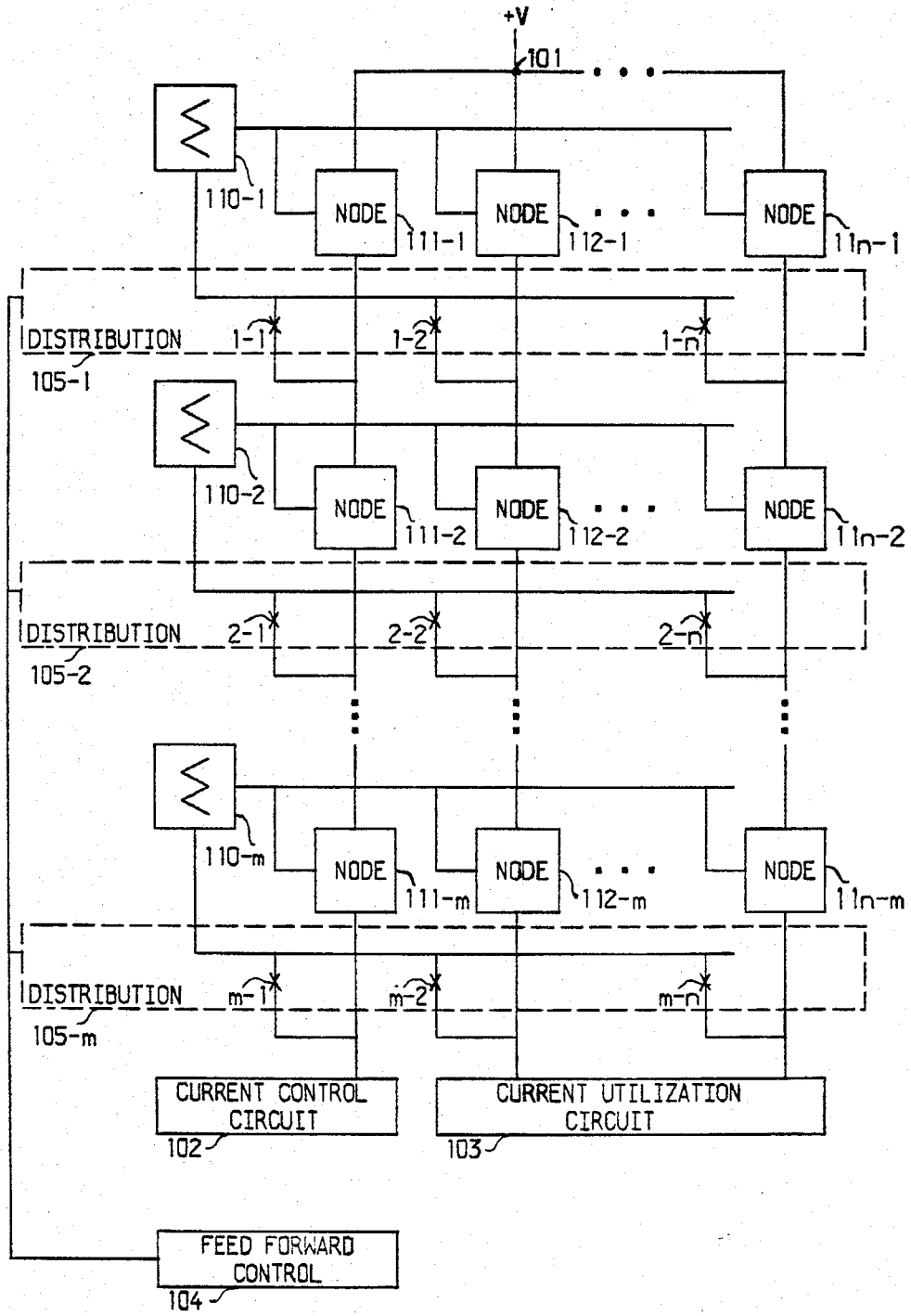
FIG. 1 illustrates the precision array structure of this invention in block diagram form.

The array structure of this invention is illustrated in block diagram form in FIG. 1. A n*m array of nodes 111-1 to 111-m is shown in FIG. 1 wherein each node is an element which produces a control/drive signal which is proportional to the signal passing through the node. The control signal produced at each node is summed on a row-by-row basis by a corresponding summing circuit (ex. 110-1). The sum of these control signals is distributed in feed-forward fashion on a row-by-row basis to one or more columns of the array. Each column so selected receives an equal portion of the control signal sum. Additionally, each row contains an equal number of control signal feed-forward connections. To accomplish this feed-forward interconnection, each row in the array is equipped with a distribution circuit 105-1 which connects the sum circuit 110-1 to the selected columns of the array by way of switch cross-points located in the distribution circuit 105-1. The operation of these switch cross-points is controlled by a feed-forward control circuit 104.

Thus, the system illustrated in FIG. 1 dynamically interconnects the control signals in the feed-forward fashion on a row-by-row basis to selected columns of the array. The control of this distribution is accomplished by an algorithm stored in feed-forward control circuit 104 such that the array output can be controlled. It is possible that while a n*m array is provided, the actual use of this arrangement may be dictated by the particular application selected so that the actual array being used is less than the supplied n*m array illustrated in FIG. 1. Thus, the feed-forward control circuit 104 selects distribution cross-points based on the array size determined by the application to minimize the effects of the feed-forward control signal distribution.

Figure 6:
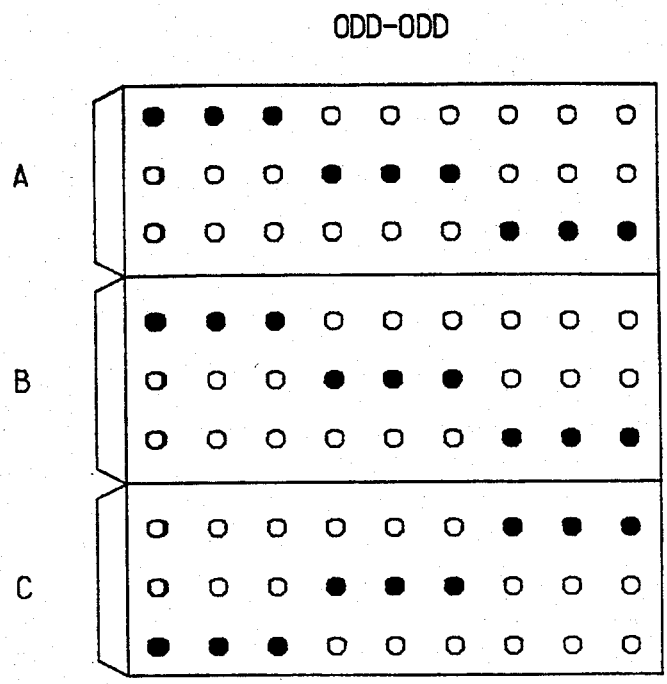
FIGS. 6–9 illustrate the basic current mirror array representation and a typical array structure of my invention.

In particular, the method of minimizing the effect of feed-forward signals is to provide each column with equal exposure to the feed-forward signals. This requires each column to have the same number of control signal feed-forward interconnections on an overall array basis. In addition, the selection of these interconnections is on the basis of minimizing the differential between the sum of the numbers of the rows which are so interconnected on a per-column basis. That is, if column 1 has feed-forward connections for both rows 1 and 7; the sum of the interconnections for this arrangement is 8. On an overall array basis, the difference between this sum and that for all other columns should be minimized to thereby minimize the effects of distributing the feed-forward control signals. This can be accomplished by dividing the array structure into a bifurcated region of symmetry (A and C) and a central region of asymmetry (B) as illustrated in FIG. 6. All feed-forward interconnections in section A of the region of symmetry are mirrored in section C so that the effects of these interconnections balances to the greatest possible degree. In most cases, simple mirroring cannot be applied throughout the array structure and therefore only a small central region of asymmetry remains for minimization.

The array illustrated in FIG. 1 includes feed-forward control circuit 104 which activates distribution circuit (105-1 to 105-m). Since distribution circuit (105-1 to 105-m) is obviously an n*m crosspoint matrix switch, the implementation of feed-forward control circuit 104 would depend on the matrix switch selected. However, feed-forward control circuit 104 is generally a stored program microprocessor or a hard wired state machine. Assuming that a microprocessor implementation is selected, it would be controlled by a set of instructions which embody the table of FIG. 10 and the rules of construction mentioned above.

The following description relates this general array structure to the particular application of a current mirror array. Thus, each node in the array is a segment of a current mirror and the signals passing through these nodes are currents. The control signals are current signals drawn from the bases of the current mirror transistors on a per-row basis. While the general dynamic array structure is illustrated in FIG. 1, fixed interconnection schemes are described below for the sake of simplicity. Therefore, feed-forward control circuit 104 and the distribution circuitry have been reduced to hardware interconnections to simplify the description. The algorithm resultant in feed-forward control circuit 104 is the definition of the hardware interconnection scheme as described in detail below.

Basic Current Mirror Unit

Figure 2:
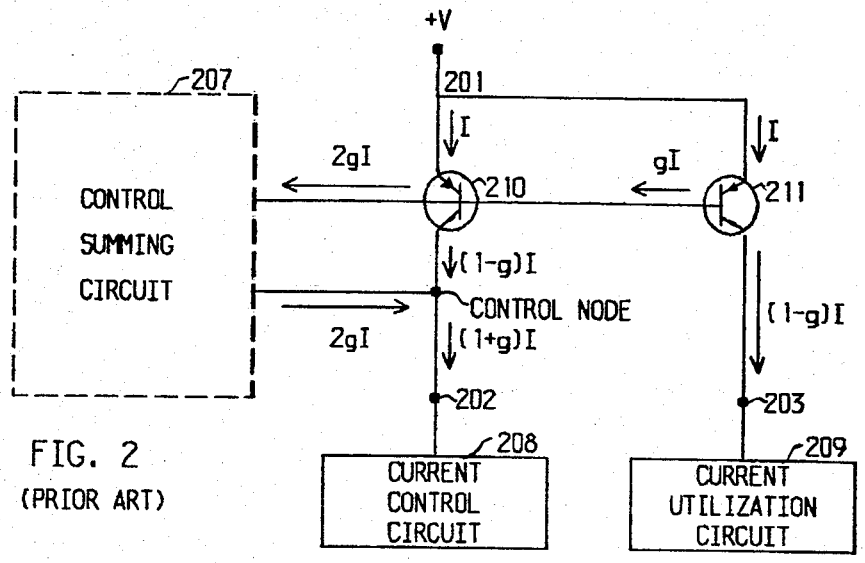
FIG. 2 (PRIOR ART)
FIGS. 2 and 3 illustrate two basic prior art current mirror units.

A basic prior art current mirror unit is illustrated in FIG. 2, which consists of first and second base-coupled transistors 210, 211. This circuit functions such that the entry currents applied to the emitter terminals of transistors 210 and 211 are identical. Additionally, the exit current from the collector terminal of transistor 210 is replicated at the collector terminal of transistor 211. This is accomplished by manufacturing transistors 210 and 211 identically so that the operating characteristics of these two transistors are essentially identical and, for the same base drive, the exit (collector) currents of these two transistors will be identical. This equality of base drive is achieved by applying equal emitter-base voltages across the emitter-base terminals of transistors 110, 111 and drawing a current (gI) from the base of each of transistors 210 and 211. These currents are summed in control summing circuit 207 and the result is applied to the collector terminal of transistor 210. (The constant g is a transistor characteristic which is defined to be equal to $1/(1+\beta)$). In this configuration, it is apparent that the collector current of each of transistors 210 and 211 is equal to $(1-g)I$. Another basic current mirror unit is illustrated in FIG. 3 and again contains first and second base-coupled transistors 310, 311. This current mirror unit adds a control transistor 312 to the current mirror unit of FIG. 2 to reduce the magnitude of the current fed to the collector terminal of transistor 310 but otherwise functions identically.

Figure 3:
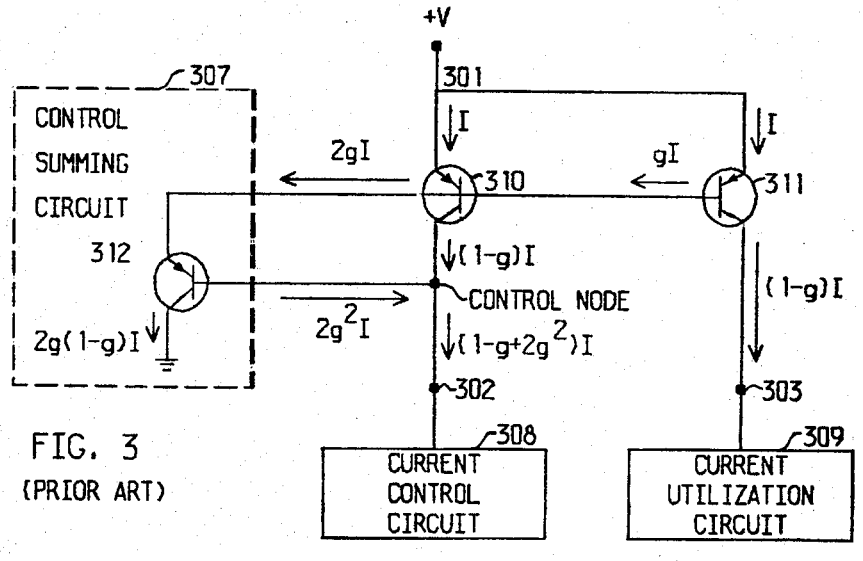
FIG. 3 (PRIOR ART)

In operation, one of the two base-coupled transistors of the current mirror unit of both FIGS. 2 and 3 is a control transistor while the other is the controlled transistor. This is accomplished, for example, by connecting a current control circuit to terminal 202 and a current utilization circuit (load) to terminal 203. Current control circuit 208 draws a particular current (input current) from the current mirror circuit and this input current is replicated as an output current by the current mirror circuit and applied to current utilization circuit 209. The difficulty with the current mirror units illustrated in FIGS. 2 and 3 is that some or all of the control current comprising the base currents of the first and second base-coupled transistors 210, 211 is fed forward to a control node comprising the collector terminal of transistor 210. This current fed to the control node is called an error current herein. This error current could be fed to a separate sink circuit, but the power drain caused by such an arrangement would be excessive in a large current mirror array structure. Therefore, the common practice is to feed this error current back to one of the columns of the array so that the exit current of the current mirror array does not significantly differ in magnitude from the entry current of the current mirror array.

Input and Output Current Equality

The error current fed to the control nodes adversely impacts upon the equality of the input and output currents which appear at terminals 202 and 203 respectively. In particular, in FIG. 3, control transistor 312 would be manufactured identically to transistors 310 and 311 and would therefore function in essentially identical fashion to these two transistors. Thus, the base current of transistor 312 would be g times the emitter current of transistor 312 or, for the current mirror unit illustrated in FIG. 3, this base current would be $2g^2I$. Obviously, an error current of $2g^2I$ has been added to the current $(1-g)I$ flowing in the left hand column of the current mirror unit of FIG. 3 while a current of $2g(1-g)I$ has been lost via the collector of control transistor 312 to circuit ground. In the current mirror unit of FIG. 2, there is no control transistor, so the error current is equal to $2g^2I$ and there is no control current fed to circuit ground. In both of these current mirror units, the error current is typically small since g is small, but when a number of these current mirror units are cascaded into a large array configuration, the additive errors become significant.

Figure 4:
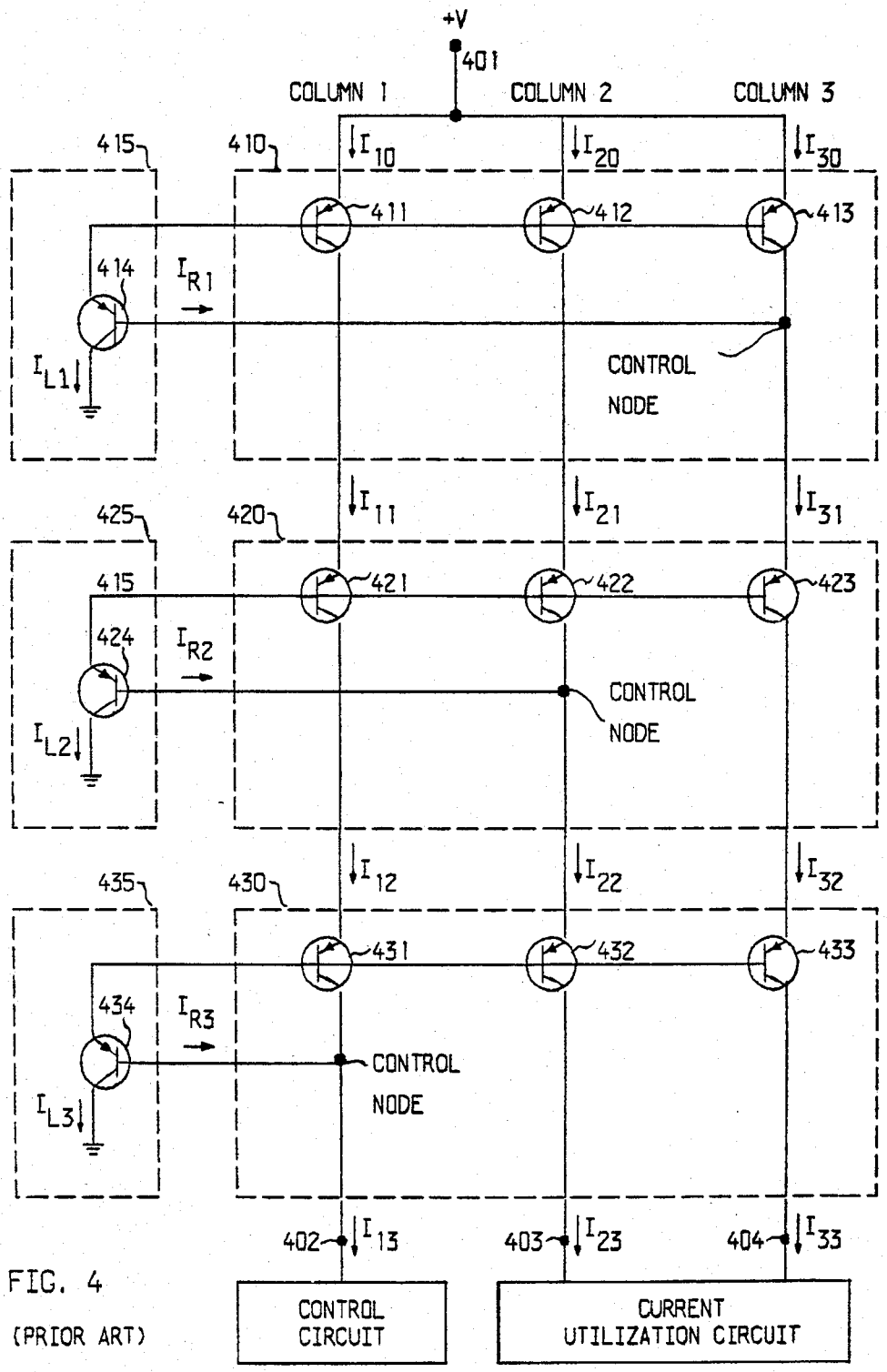
FIG. 4 (PRIOR ART)
FIG. 4 illustrates the prior art cascade current mirror array structure of U.S. Pat. No. 4,166,971.
Figure 5:
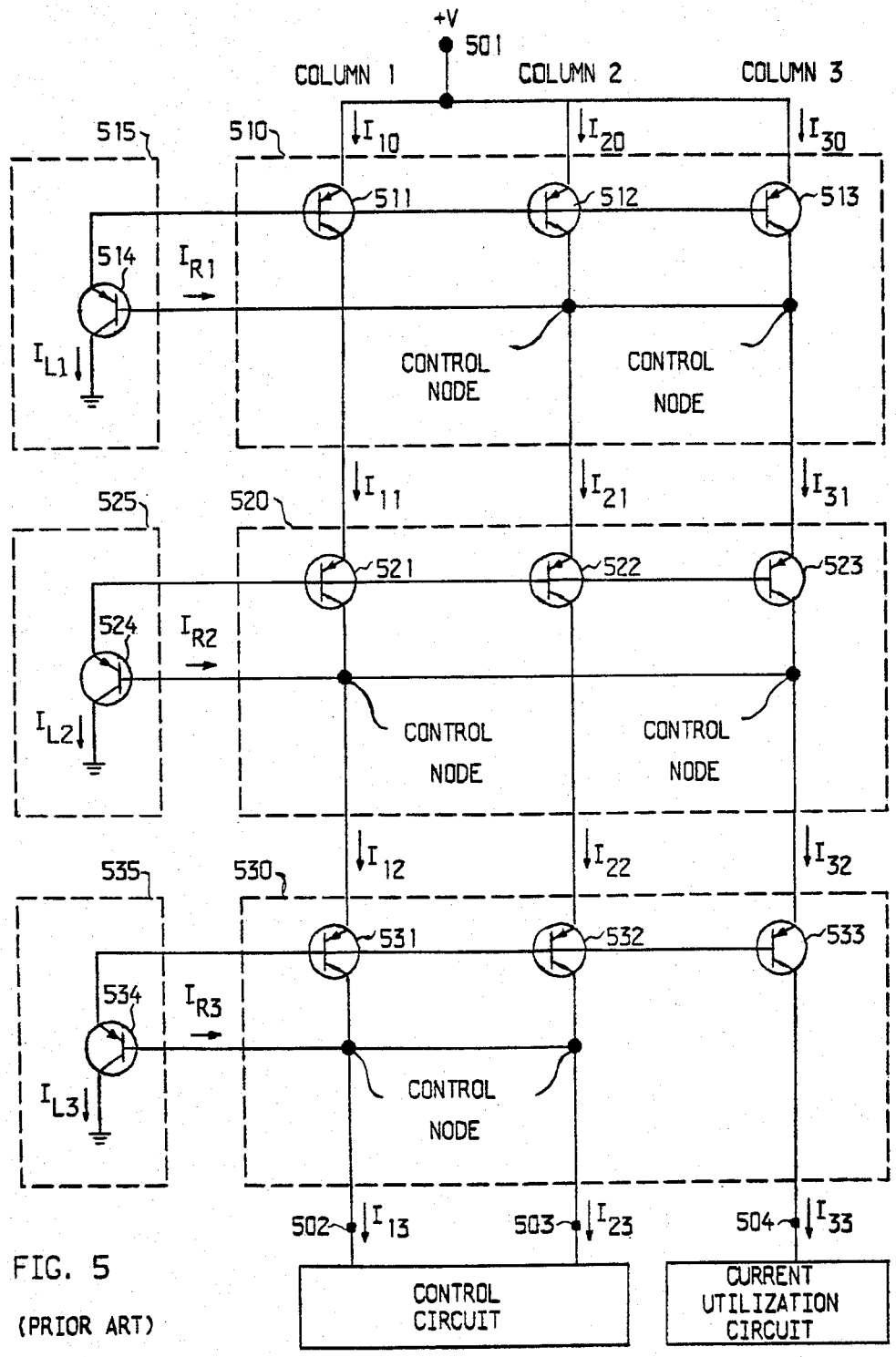
FIG. 5 (PRIOR ART)
FIG. 5 illustrates an alternative cascade current mirror array structure from U.S. Pat. No. 4,166,971.

The following general discussion is relevant to both current mirror units illustrated in FIGS. 2 and 3 but, for simplicity of description, the current mirror unit of FIG. 3 will be used. to illustrate the current mirror array structure of this invention. As can be seen from FIG. 4, one method of minimizing the effect of the error current on the balance of output currents is to distribute the connection of the error current in each successive row of the current mirror array to a different column of the current mirror array. An alternative to this arrangement is illustrated in FIG. 5 where this error current is distributed to several different columns in each row. In all of these cases it is important to remember that even though the distribution of control nodes is equalized on a column basis, the exit currents of each row are not equal to the entry currents in that row. For the current mirror unit of FIG. 3, the exit current of row 1 is $(1-g+2g^2)I$ while its entry current is I. For the current mirror unit of FIG. 2, the exit current would be $(1+g)I$ for an entry current I.

Current Mirror Array

In an array structure, a similar proportional change in currents will be evidenced in each successive row of the array. Therefore, the error current fed forward to the various columns changes row by row as you proceed through the array structure. Since it is important to provide equalized exposure for each column in this array to the base current diversion, this deviation of error current magnitudes must be compensated for. Thus, the object of the subject arrangement is to obtain a predictable balance of these error currents which are fed forward to the various columns in this array.

For simplicity of description, we will discuss a current mirror array which is formed of PNP bipolar transistors. In such a current mirror array, it is obvious that the columns are completely interchangeable and any columnar arrangement discussed herein can be rearranged to suit the needs of the circuit designer. It is also apparent from this structure that all square current mirror arrays produce input and output currents that can be specified as a power series based on the constant g. This power series is given by the following equation:

$$\frac{I_{OUT}}{I_{IN}} = 1 - ng + \left\{\frac{(n+n^2)}{2}\right\} g^2 - \left\{\frac{(-4n+3n^2+n^3)}{6}\right\} g^3 + \left\{\frac{-6n-25n^2+6n^3+n^4}{24}\right\} g^4 - \frac{n}{k}\{S(n,p,r)\} g^4 \quad (1)$$

In this formula, n is the number of rows in the square current mirror array (and obviously the number of columns also) and p is the number of columns (control nodes) in each row connected to the base of each control transistor. Thus, it is obvious that this equation can be divided into two segments. A first segment is a constant K(n) which is a function of the current mirror array size, while the second segment is variable V(n,p,r) and depends on the control node configuration (r,p) as well as the current mirror array size (n). This relationship can be expressed as follows:

$$\frac{I_{OUT}}{I_{IN}} = 1 - K(n) - V(n,p,r) \quad (2)$$

The basic hypothesis is therefore that given a particular current mirror array size n*m (where m is an integer multiple of n) and a particular number p of control feedforward connections per row, then each columnar current is strictly a function of its nodal pattern arrangement (r). Thus, the columnar current is independent of the remainder of the current mirror array. Column positions may be interchanged at will as long as each row contains p control feedforward connections. However, in an n*n array structure, the number of possible array interconnections is:

$$P = \frac{n!}{p!(n-p)!} \tag{3}$$

In a large array, this number becomes excessively large and some ordered structure selection is necessary.

Odd/Odd Array

For the following discussion, a "blank crosspoint" is a current mirror transistor that feeds current straight through to the next row without the addition of the fractional or total error current to the collector terminal of the transistor. A "nodal crosspoint" is one that has the addition of the error current to the collector terminal of the transistor via a control node. FIG. 6 illustrates a typical 9*9 current mirror array with each of the base-coupled transistors of a blank crosspoint being represented by a 0. In this structure, there are eighty-four possible control feed-forward interconnection arrangements if we select p=3. This also is defined as an odd/odd array since both n and p are odd. With each nodal crosspoint illustrated by *, FIG. 6 illustrates the optimum control feedforward interconnection for this current mirror array. This is accomplished by dividing the current mirror array structure into a bifurcated region of symmetry (A and C) and a central region of asymmetry (B). All nodal crosspoints in section A of the region of symmetry are mirrored in region C so that the effects of these nodal crosspoints balance to the greatest possible degree. The selection of nodal crosspoints in each row is dependent only on the requirement that, in the region of symmetry, all columns receive equal exposure. This requirement is satisfied in FIG. 6 by the nodal crosspoints being the first three crosspoints in the first and ninth rows, the second three crosspoints in the second and eighth rows and the last three crosspoints in the third and seventh rows. Obviously, there are many other patterns of nodal crosspoints which satisfy this requirement and produce the same result.

However, since in this case n and p are odd numbers, simple mirroring cannot be applied throughout the current mirror array structure and, therefore, a central region of asymmetry of size n/p rows by n columns remains for minimization. In the 9*9 array case, only the center three rows must be ordered to minimize the columnar current deviation. Since this region of asymmetry is a 3*9 array with three nodal crosspoints per row, the selection of connections shown in FIG. 6 is an optimum configuration. This is simply a replication of the pattern used in the region of symmetry starting with the leftmost column. This selection of nodal crosspoints again is just one of many that would produce identical results. As long as the overall current mirror array satisfies the above-mentioned equal column exposure requirement, the deviation in column currents is minimized.

Odd/Even, Even/Odd and Even/Even Arrays

Figure 7:
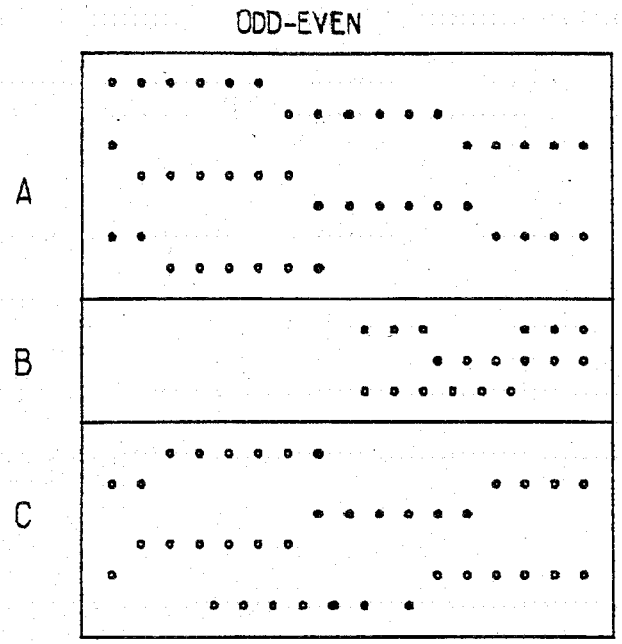
Figure 8:
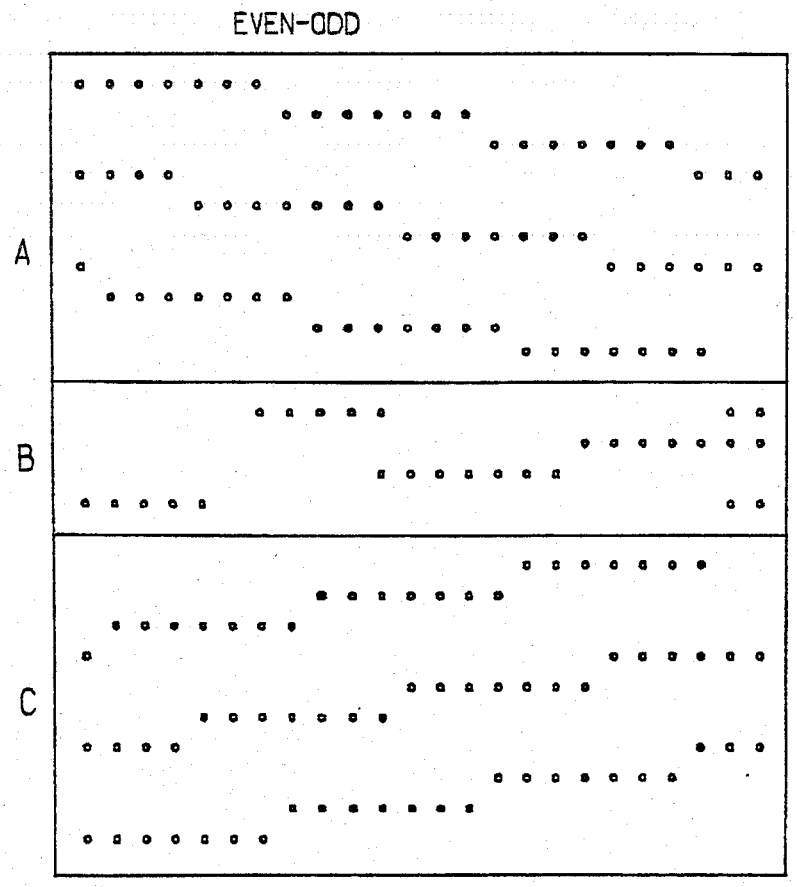
Figure 9:
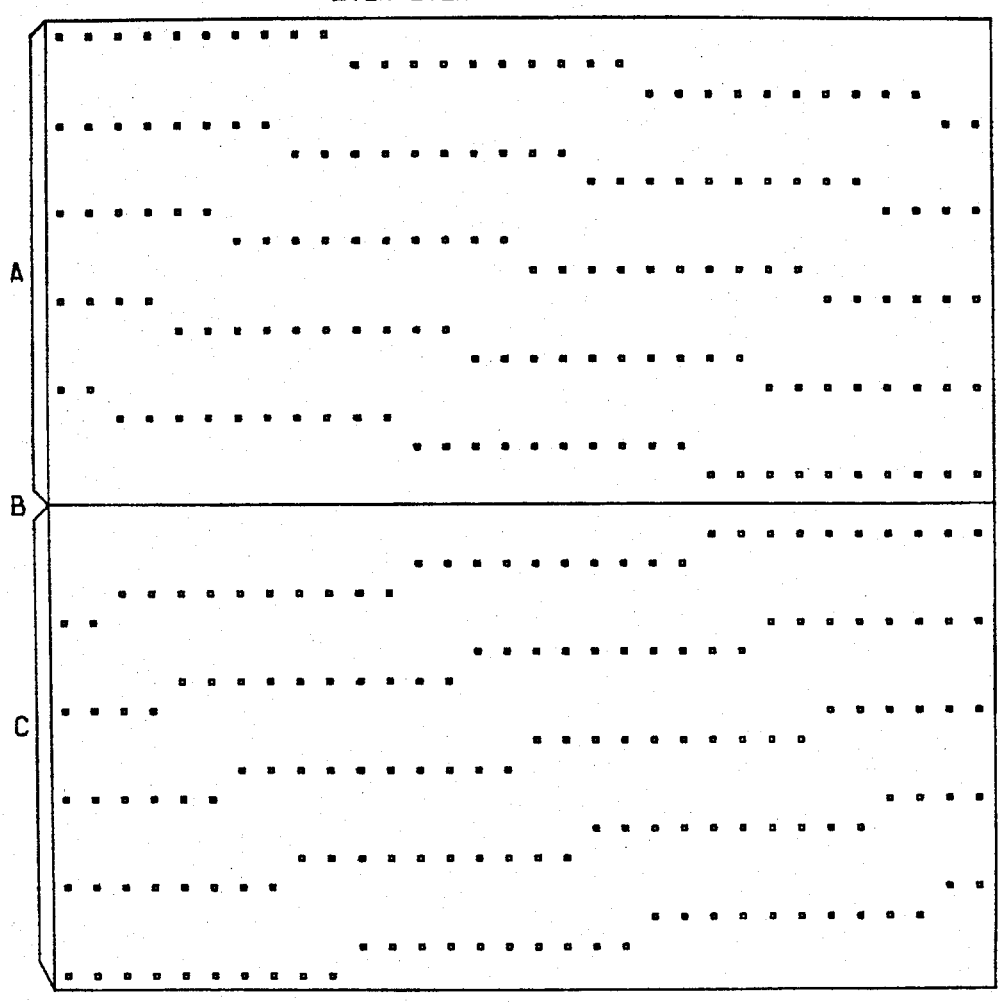

FIG. 7 illustrates a 17*17 current mirror array with each row having 6 nodal crosspoints. As can be seen in FIG. 7, much of the array falls into the bifurcated region of symmetry and the simple sliding interconnection scheme satisfies the balance requirements. The region of asymmetry (B) occupies only 3 rows of this array and the scheme selected in FIG. 7 results in the minimization of the difference between the sums of the nodal interconnection on a column-by-column basis. A similar scheme is illustrated in FIG. 8 where a 24*24 array having 7 nodal crosspoints per row is illustrated. Once again, the central region of asymmetry occupies 3 rows and it is apparent that the nodal cross-point selection for these 3 rows is a far less challenging task than determining the optimal cross-point interconnection for the entire 24*24 array. Finally, FIG. 9 illustrates an even/even array wherein the array is a 32*32 structure with 10 nodal crosspoints per row. In such an arrangement, the region of asymmetry collapses to zero and a completely symmetric pattern can be realized in this array.

Deviation Range

This result can be illustrated in table form in FIG. 10, where the various array possibilities are listed. Thus, for n and p both even, maximum columnar balance can be achieved since the region of symmetry encompasses all of the current mirror array. For all other n and p, partial balance can be obtained by concentrating the unbalances in a region of asymmetry centered about the horizontal center axis of the current mirror array. The balance of such configurations can be signified by a figure of merit called the deviation range (dr) which indicates the difference between the maximum and minimum column currents. In particular, as was indicated above, each column current contains a fixed K(n) and a variable V(n,p,r) term. The difference between any two columns is therefore the variation between the corresponding variable terms. This difference, as stated above, is solely due to the selection of the nodal crosspoint locations. The current in each column of the current mirror array is therefore the entry current less the control current withdrawn from each row plus the error current inserted at row r, which error current is subsequently reduced in the following n-r rows by having a portion of it withdrawn at each successive row as a component of the control current for those rows. Thus, the variable component of the exit current due to a single error current being added in row r, the partial variable error (PVE), is given by:

$$PVE = \frac{ng^2}{p}(1 - g + g^2)^{r-1}(1-g)^{n-r} \tag{4}$$

With this being the case, it is apparent that for the current mirror element of FIG. 2 being the basic building block of a current mirror array, the above formula is given by:

$$PVE1 = \frac{ng}{p}(1-g)^{n-r} \tag{5}$$

for that case. These equations can be expanded and they become respectively:

$$PVE1 = \frac{n}{p}\left\{ g + (n-r)g^2 + \frac{(n-r-1)(n-r-2)}{2!}g^3 + \frac{(n-r-1)(n-r-2)(n-r-3)}{3!}g^4 + \dots \right\} \tag{6}$$

and

-continued $$PVE2 = \frac{n}{p}\left\{ (1-g)^{n-1}g^2 + (r-1)(1-g)^{n-2}g^4 + \frac{(r-1)(r-2)}{2!}(1-g)^{n-3}g^6 + \frac{(r-1)(r-2)(r-3)}{3!}(1-g)^{n-4}g^8 + \ldots \right\} \quad (7)$$

It is apparent that the first term of each of these equations is a constant dependent upon the current mirror array size. The second most significant term is a linear function of r, the row number of the nodal crosspoint; the third most significant term is a quadratic function of r; and so on for successive terms. Thus, it is obvious that the difference in exit currents among the columns of a current mirror array will be given by:

$$dr1 = PVE1 - PVE1' = \frac{n}{p}\{(ldr)g^2 + (qdr)g^4 + \ldots\} \quad (8)$$

$$dr2 = PVE2 - PVE2' = \frac{n}{p}\{(ldr)(1-g)^{n-2}g^4 + (qdr)(1-g)^{n-3}g^6 + \ldots\} \quad (9)$$

where (ldr) indicates the term is a linear function of r and (qdr) indicates the term is a quadratic term of r.

Rules of Construction

Thus, to minimize the deviation range, it is important to first minimize the linear (ldr) term of each equation. This can only be accomplished by selecting the nodal crosspoints so that the sum of the row numbers of the nodal crosspoints in each column differ by the minimum amount. This difference in the sum of row numbers is minimized by selecting the nodal crosspoints as described above: using a bifurcated region of symmetry with each region being the mirror image of the other with respect to the horizontal axis and also providing equal exposure horizontally with each column having the same number of nodal crosspoints on a total array basis.

By following these rules of construction, the linear (ldr) term can be reduced to the value indicated in the table of FIG. 10. Since the last case illustrated in FIG. 10 (n, p even) has an (ldr) of zero, the next most significant term (qdr) must be minimized. This minimization is accomplished by selecting the nodal crosspoints not only to make the (ldr) zero but also to reduce the difference between columns of the sum of the square of the row numbers. It must be remembered that all successive terms in the PVE1 and PVE2 equations are ignored in this scheme because it is assumed that $g << 1$ and since successive terms of these equations differ by $g^2$, they are therefore much smaller than the higher order term being considered.

Thus, the table of FIG. 10 illustrates the minimum ldr obtainable for all combinations of n and p with an n*n array. For an n*m array (where m is an integer multiple of n) this basic n*m array can simply be replicated m/n times to obtain the same result.

In addition, this description has centered around a current mirror array but need not be limited to such devices. The basic node described above is comprised of an element which produces a drive or control signal which is proportional to the signal passing through the node (entry signal). Thus, the disclosed array structure is applicable to any array wherein the nodes are comprised of some element which produces a control signal which is proportional to the entry signal.

While a specific embodiment of the invention has been disclosed, variations in structural detail, within the scope of the appended claims, are possible and are contemplated. There is no intention of limitation to what is contained in the abstract or the exact disclosure as herein presented. The above-described arrangements are only illustrative of the application of the principles of the invention. Normally, other arrangements may be devised by those skilled in the art without departing from the spirit and the scope of the invention.

What is claimed is:

1. A method of interconnecting control points in an n*m array where n is the number of columns in said array and m is the number of rows in said array, and each node of said array produces a control signal which is proportional to the signal passing through said node comprising the steps of:

summing said control signals on a row-by-row basis;

selecting a fixed number of said nodes in each of said rows on the basis of minimizing the differential between sums of the row numbers of said selected nodes on a columnar basis for the overall array; and distributing on a row-by-row basis an equal share of said sum of control signals to the columns associated with each of said selected nodes.

2. The method of claim 1 wherein the step of selecting includes the step of:

equalizing the number of selected nodes on a column-by-column basis.

3. The method of claim 1 wherein the step of selecting further includes the steps of:

allocating a bifurcated region which is symmetric about the horizontal center line of said array; and replicating the nodal selections in one segment of said bifurcated region on a mirror image basis about said horizontal center line with the nodal selections in the other segment of said bifurcated region.

4. The method of claim 3 wherein the step of selecting further includes the step of:

equalizing the number of selected nodes on a column-by-column basis in said bifurcated region.

5. The method of claim 4 wherein the step of selecting includes the step of:

providing said fixed number of nodal selections per row in the segment of said array outside said bifurcated region to equalize the number of nodal selections on a column-by-column basis for said array.

6. A method of interconnecting control points in an n*n array where the number of columns and rows included said array are equal and said equal number of columns and rows is represented as a single variable n, wherein n is an even number and wherein each node of said array produces a control signal which is proportional to the signal passing through said node, comprising the steps of:

summing said control signals on a row-by-row basis;

selecting a fixed number of said nodes in each of said rows on the basis of minimizing the difference between sums of the squares of the row numbers of said selected nodes on a columnar basis for the overall array; and distributing on a row-by-row basis an equal share of said sum control signals to each of said selected nodes.

7. The method of claim 6 wherein the step of selecting includes the step of:

equalizing the number of selected nodes on a column-by-column basis.

8. A method of interconnecting the base terminals of the transistors in an n*m current mirror array where n is the number of columns in said array and m is the number of rows in said array, and and a control current is available at each of said base terminals to control the operation of the associated transistor, comprising the steps of:

joining all of said base terminals on a row-by-row basis to sum said control currents on a row-by-row basis;

selecting a fixed number of exit leads in each of said rows on the basis of minimizing the differential between the sums of the row numbers of said selected exit leads on a columnar basis for the overall array; and connecting said joined base terminals to said selected exit leads on a row-by-row basis to distribute an equal share of said summed control currents to each of said selected exit leads.

9. The method of claim 8 wherein the step of selecting includes the step of:

equalizing the number of exit lead connections on a column-by-column basis.

10. The method of claim 8 wherein the step of selecting further includes the steps of:

allocating a bifurcated region which is symmetric about the horizontal center line of said current mirror array; and replicating the exit lead connections in one segment of said bifurcated region on a mirror image basis about said horizontal center line with the exit lead connections in the other segment of said bifurcated region.

11. The method of claim 10 wherein the step of selecting further includes the step of:

equalizing the number of exit lead connections on a column-by-column basis in said bifurcated region.

12. The method of claim 11 wherein the step of selecting includes the step of:

providing said fixed number of exit lead connections per row in the segment of said current mirror array outside said bifurcated region to equalize the number of exit lead connections on a column-by-column basis for said current mirror array.

13. A method of interconnecting the base terminals of the transistors in an n*n current mirror array where the number of columns and rows included in said array are equal and said equal number of columns and rows is represented as a single variable n, wherein n is an even number and wherein a control current is available at each of said base terminals to control the operation of the associated transistor, comprising the steps of:

joining all of said base terminals on a row-by-row basis to sum said control currents on a row-by-row basis;

selecting a fixed number of exit leads in each of said rows on the basis of minimizing the differential between the sums of the squares of the row numbers of said selected exit leads on a columnar basis for the current mirror array; and connecting said joined base terminals to said selected exit leads on a row-by-row basis to distribute an equal share of said summed control currents to each of said selected exit leads.

14. In an n*m array of nodes where n is the number of columns in said array and m is the number of rows in said array and each node of said array produces a control signal which is proportional to the signal passing through said node, control signal interconnection apparatus comprising:

summing means connected to all of said nodes and responsive to said control signals for summing said control signals on a row-by-row basis;

control means responsive to the size of said array for selecting a fixed number of said nodes in each of said rows on the basis of minimizing the differential between sums of the rows numbers of said selected nodes on a columnar basis for the overall array; and distribution means connected to said summing means and responsive to said summed control signals for distributing equal portions of said summed control signals to the columns associated with each of said selected nodes.

* * * * *